US008056519B2

(12) United States Patent
Cuatt et al.

(10) Patent No.: US 8,056,519 B2
(45) Date of Patent: Nov. 15, 2011

(54) CAMSHAFT PHASER INTERMEDIATE LOCKING PIN AND SEAT

(75) Inventors: Daniel Richard Cuatt, Rush, NY (US); Michael James Fox, Stafford, NY (US); Thomas Huntington Fischer, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 164 days.

(21) Appl. No.: 12/534,188

(22) Filed: Aug. 3, 2009

(65) Prior Publication Data

US 2010/0031906 A1 Feb. 11, 2010

Related U.S. Application Data

(60) Provisional application No. 61/188,615, filed on Aug. 11, 2008.

(51) Int. Cl.
*F01L 1/34* (2006.01)

(52) U.S. Cl. ..... 123/90.17; 123/90.15; 464/160

(58) Field of Classification Search ..... 123/90.15, 123/90.17, 90.16, 90.18; 464/1, 2, 160
See application file for complete search history.

(56) References Cited

U.S. PATENT DOCUMENTS 5,960,757 A * 10/1999 Ushida ..... 123/90.17

* cited by examiner

*Primary Examiner* — Ching Chang
(74) *Attorney, Agent, or Firm* — Thomas N. Twomey

(57) ABSTRACT

A vane-type camshaft phaser for an internal combustion engine, in which an intermediate locking pin and seat are provided for locking the camshaft phaser at a position intermediate of its full advanced and retard positions, one of the locking pin and seat having a non-circular cross section, and the cross-sectional shapes of the locking pin and seat being substantially dissimilar to each other.

20 Claims, 6 Drawing Sheets

CAMSHAFT PHASER INTERMEDIATE LOCKING PIN AND SEAT

TECHNICAL FIELD OF INVENTION

The invention relates to camshaft phasers for internal combustion engines; more particularly to vane-type camshaft phasers with an intermediate locking pin and seat for locking the camshaft phaser at a position intermediate of its full advance and retard positions; and most particularly to such a camshaft phaser with a locking pin and seat wherein one of the locking pin and seat has a non-circular cross-sectional shape and the cross-sectional shapes of the locking pin and seat are substantially dissimilar.

BACKGROUND OF INVENTION

Camshaft phasers for varying the phase relationship between the crankshaft and a camshaft of an internal combustion engine are well known. A prior art vane-type phaser generally includes a plurality of outwardly-extending vanes on a rotor interspersed with a plurality of inwardly-extending lobes on a stator, thereby forming alternate advance and retard chambers between the vanes and lobes. Engine oil is supplied via a multiport oil control valve, in accordance with an engine control module, to either the advance or retard chambers as required to meet current or anticipated engine operating conditions.

It is also well known to provide prior art cam phasers with an intermediate locking pin and seat for locking the camshaft phaser at a position intermediate of its full advance and retard positions. See for example, US Patent Application Publication No. 2007/0277757 which was published Dec. 6, 2007, the disclosure of which is expressly incorporated herein by reference. Such prior art intermediate locking pins and seats are known to have circular cross-sectional shapes. A known disadvantage to using locking pins and seats with circular cross-sectional shapes is the high level of precision to which the locking pin and seat must be manufactured in order to allow the locking pin to slide freely into the seat while maintaining an acceptable amount of lash between the rotor and stator when the locking pin is engaged with the seat. Manufacturing the locking pin and seat to such a high level of precision can be cost prohibitive. If a lesser degree of precision is used to manufacture the locking pin and seat, the locking pin may not move freely into and out of the seat, or there will be an excessive amount of lash between the rotor and stator which can cause objectionable noise as well as durability issues.

What is needed is a camshaft phaser with an intermediate locking pin and seat that require less precision to manufacture, and yet is durable and operates properly and quietly. Therefore, it is a principal object of the present invention to provide a locking pin and seat for a camshaft phaser that requires less precision to manufacture while allowing the locking pin to move freely into the seat and maintain an acceptable level of lash between the rotor and stator.

SUMMARY OF THE INVENTION

Briefly described, a camshaft phaser for advancing and retarding the timing of valves in an internal combustion engine includes a stator having a plurality of lobes and a rotor selectively rotatably disposed within the stator and having a plurality of vanes interspersed with the stator lobes. A locking pin is slideably disposed in a first bore of one of the stator and rotor and includes a pin locking end, a shoulder end, and a pin intermediate section connecting the pin locking end and the shoulder end. A seat is formed in the other of the stator and the rotor for selectively receiving the pin locking end of the locking pin to secure the rotor against rotation within the stator. One of the pin locking end of the locking pin and the seat has a non-circular cross-sectional shape and the cross-sectional shape of the pin locking end of the locking pin is substantially dissimilar to the cross-sectional shape of the seat. Furthermore, the pin locking end of the locking pin and the seat form an advance contact zone in the advance direction of rotor rotation and a retard contact zone in the retard direction of rotor rotation.

Further features and advantages of the invention will appear more clearly on a reading of the following detailed description of the preferred embodiment of the invention, which is given by way of non-limiting example only and with reference to the accompanying drawings.

BRIEF DESCRIPTION OF DRAWINGS

This invention will be further described with reference to the accompanying drawings in which.

DETAILED DESCRIPTION OF INVENTION

Figure 1A:
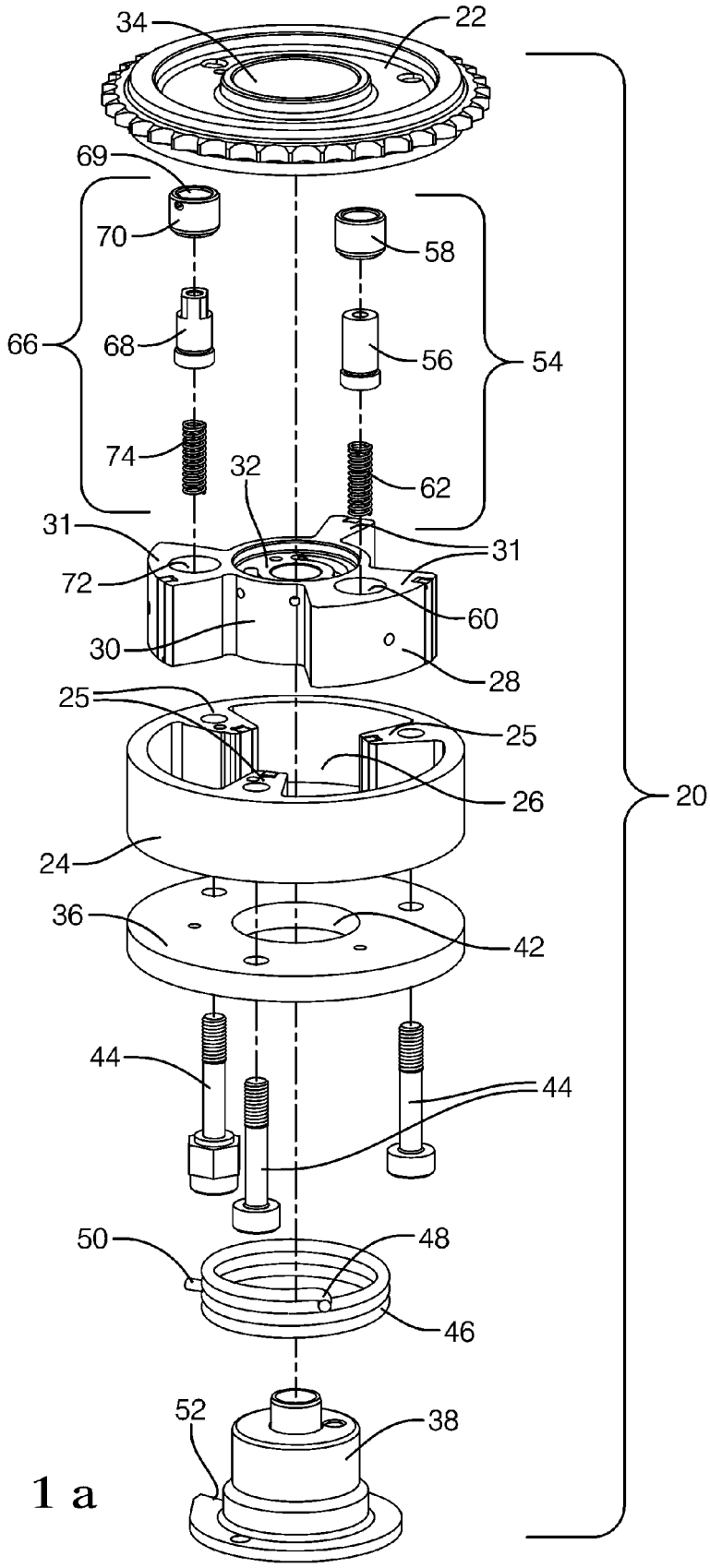
FIGS. 1*a* and 1*b* are exploded isometric views of a camshaft phaser in accordance with the present invention.
Figure 1B:
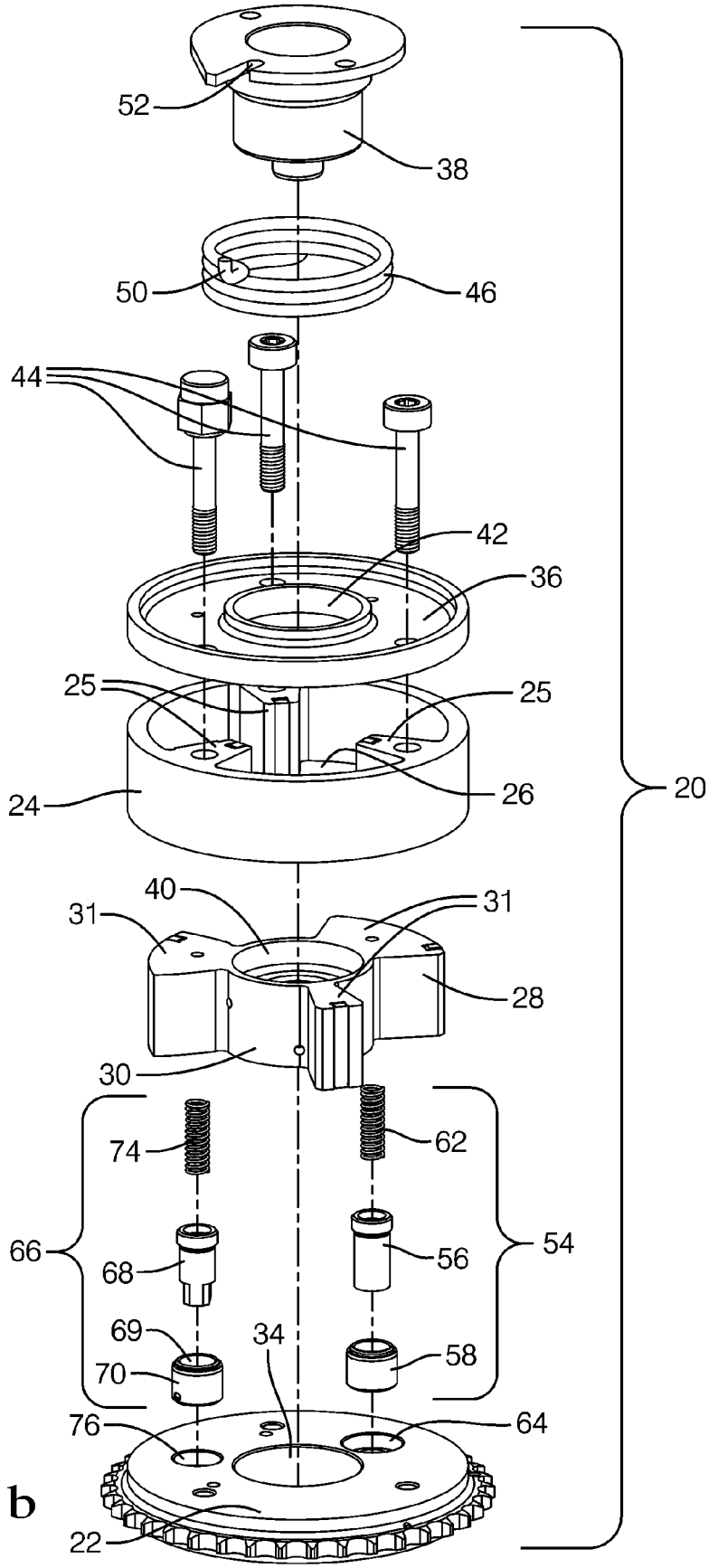

In accordance with the present invention and referring to FIGS. 1*a* and 1*b*, camshaft phaser 20 is shown. Camshaft phaser 20 includes pulley or sprocket 22 for engaging a timing chain or belt (not shown) operated by an engine crankshaft (not shown). Stator 24 is disposed against pulley/sprocket 22 and is rotationally immobilized with respect thereto. Stator 24 is provided with a plurality of inwardly extending lobes 25 defining central chamber 26 for receiving rotor 28 having hub 30 provided with a plurality of vanes 31 extending radially outward therefrom; vanes 31 being interspersed with lobes 25 when rotor 28 is received in central chamber 26. Hub 30 is provided with first recess 32 that is coaxial to central bore 34 in pulley/sprocket 22, allowing access for an end of an engine camshaft (not shown) to extend into hub 30 during assembly of camshaft phaser 20 to an internal combustion engine (not shown). Central chamber 26 is closed by cover plate 36, forming advance and retard chambers between rotor 28 and stator 24 in central chamber 26. Advance and retard chambers are located on opposite sides of each vane 31, forming a cooperating pair of chambers, and both chambers of each cooperating pair are located between circumferentially adjacent stator lobes 25. Rotor hub extension 38 is pressed into second recess 40 in hub 30 and extends rotatably through central opening 42 in cover plate 36. Cover plate 36 and stator 24 are secured to pulley/sprocket 22 with a plurality of bolts 44 extending through stator 24 outside of central chamber 26.

Torsional bias spring 46 is disposed coaxially of rotor hub extension 38, having first tang 48 anchored to sprocket/pulley 22, as for example, by engagement with the protruding head of one of the plurality of bolts 44, and having second tang 50 anchored to rotor 28, as for example, by engagement with slot 52 in rotor hub extension 38. Bias spring 46 is pre-loaded between rotor 28 and stator 24 during assembly of camshaft phaser 20 to urge rotor 28 toward an advanced operational position within central chamber 26.

Primary locking pin assembly 54 is provided to limit rotor 28 against rotation within stator 24 within an acceptable angular range of the intermediate locking position, for example, 6 degrees. Primary locking pin assembly 54 includes primary locking pin 56 slideably received in primary locking pin bushing 58 which is pressed into primary locking pin bore 60 located in one of the plurality of vanes 31 of rotor 28. Primary locking pin assembly 54 also includes primary locking pin compression spring 62 for urging primary locking pin 56 selectively into primary seat 64 formed in pulley/sprocket 22. When it is desired to retract primary locking pin 56 from primary seat 64, pressurized oil is applied to primary locking pin 56 to overcome the force of primary locking pin compression spring 62, thereby causing primary locking pin 56 to retract from primary seat 64.

Intermediate locking pin assembly 66 is provided to selectively secure rotor 28 against rotation within stator 24 in a position intermediate of the full advance and full retard positions of rotor 28 within stator 24.

Figure 4:
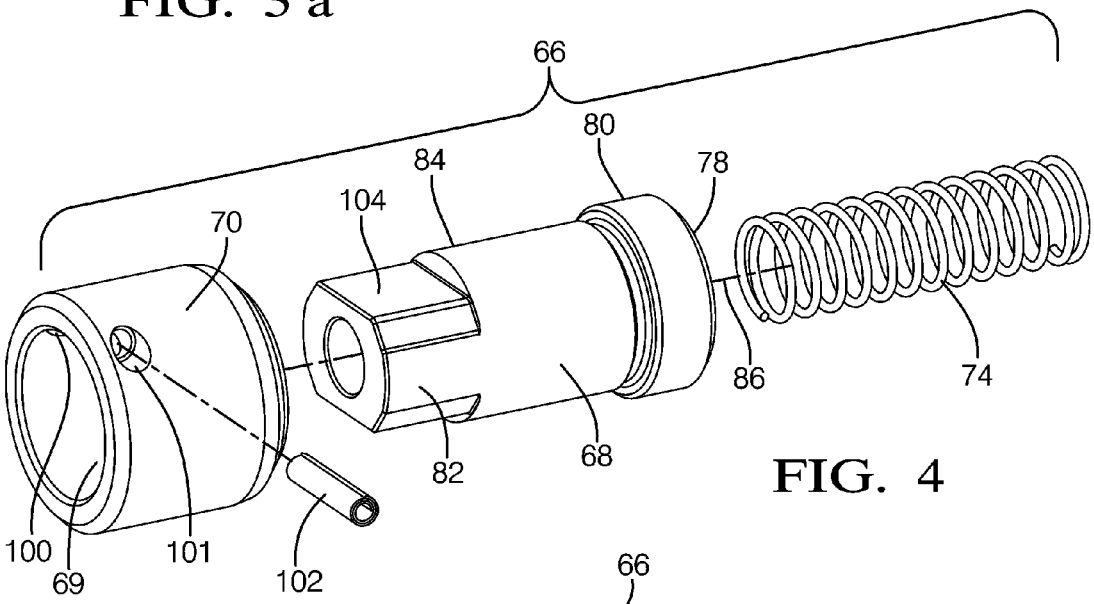
FIG. 4 is an isometric exploded view of an intermediate locking pin assembly in accordance with the present invention.
Figure 5:
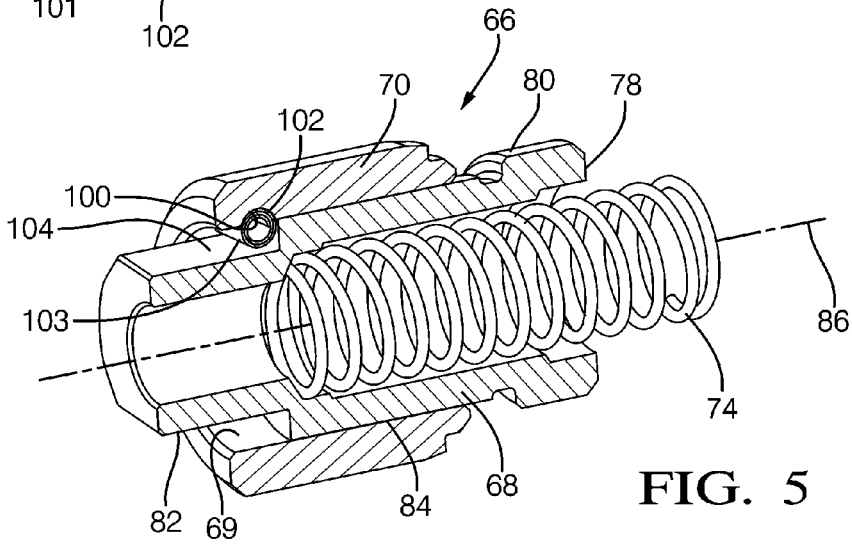
FIG. 5 is an isometric cross-sectional view of an intermediate locking pin assembly in accordance with the present invention.

Referring now to FIGS. 4 and 5, intermediate locking pin assembly 66 includes intermediate locking pin 68 slideably received in intermediate locking pin bushing bore 69 of intermediate locking pin bushing 70. Intermediate locking pin bushing 70 is fixedly received by press fit into intermediate locking pin bore 72 (FIG. 1*a*) located in one of the plurality of vanes 31 of rotor 28. Intermediate locking pin assembly 66 also includes intermediate locking pin compression spring 74 for urging intermediate locking pin 68 selectively into intermediate seat 76 (FIG. 1*b*) formed in pulley/sprocket 22. When it is desired to retract intermediate locking pin 68 from intermediate seat 76, pressurized oil is applied to intermediate locking pin 68 to overcome the force of intermediate locking pin compression spring 74, thereby causing intermediate locking pin 68 to retract from intermediate seat 76.

In a first preferred camshaft phaser embodiment, intermediate locking pin 68 has shoulder end 78 defined by annular shoulder 80, pin locking end 82 that is received by intermediate seat 76 in the intermediate locking position, pin intermediate section 84 that connects shoulder end 78 to pin locking end 82, and longitudinal axis 86 which, in the intermediate locking position, coincides with central axis 87 (FIG. 9) of intermediate seat 76. Intermediate locking pin 68 shares longitudinal axis 86 with intermediate locking pin bushing 70 when intermediate locking pin 68 is installed therein.

Figure 8A:
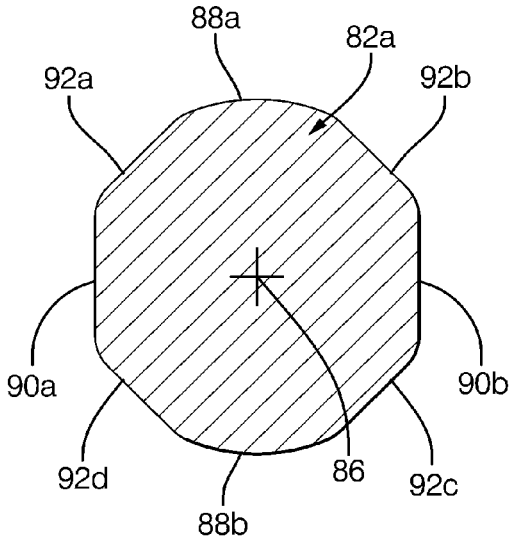
FIGS. 8*a*-8*c* are orthographic cross-sectional views of intermediate locking pins of a first embodiment of a camshaft phaser in accordance with the present invention.
Figure 8B:
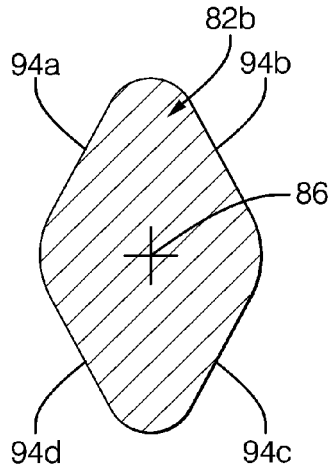
Figure 8C:
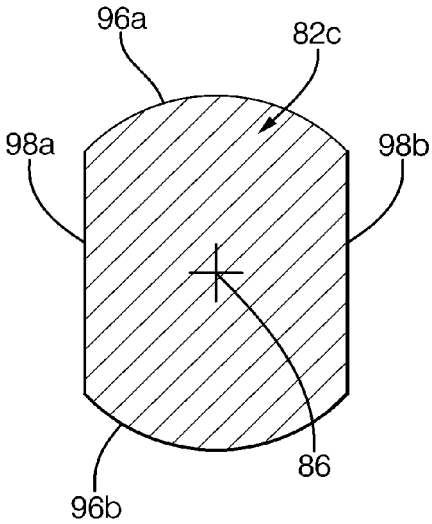

In this first embodiment, the cross-sectional shape of pin locking end 82 of intermediate locking pin 68 taken perpendicular to longitudinal axis 86 is non-circular in shape. Referring now to FIGS. 8*a*-8*c*, shown are three examples of preferable cross-sectional shapes of pin locking end 82. FIG. 8*a* shows a first preferable cross-sectional shape for of pin locking end 82*a*, the shape being a modified octagon formed by opposing arcuate pin side surfaces 88*a* and 88*b*, opposing parallel pin side surfaces 90*a* and 90*b*, and connecting pin side surfaces 92*a*, 92*b*, 92*c*, and 92*d* joining opposing arcuate pin side surfaces 88*a* and 88*b* to opposing parallel pin side surfaces 90*a* and 90*b*. Preferably, opposing arcuate pin side surfaces 88*a* and 88*b* coincide with the diameter of pin intermediate section 84 (FIGS. 4 and 5). However, opposing arcuate pin side surfaces 88*a* and 88*b* may each have a radius less than the radius of pin intermediate section 84. Opposing arcuate pin side surfaces 88*a* and 88*b* may also each have a radius less than the radius of intermediate seat 76 which may be circular in cross-sectional shape. Optionally, the longitudinal edges formed at the junctures between adjacent surfaces 88*a*, 88*b*, 90*a*, 90*b*, 92*a*, 92*b*, 92*c*, and 92*d* may be eased with radii as shown.

FIG. 8*b* shows a second preferable cross-sectional shape of pin locking end 82*b*, the shape being a quadrilateral, and preferably a rhombus formed by quadrilateral pin side surfaces 94*a*, 94*b*, 94*c*, and 94*d*. Optionally, the longitudinal edges formed at the junctures between adjacent surfaces 94*a*, 94*b*, 94*c*, and 94*d* may be eased with radii as shown.

FIG. 8*c* shows a third preferable cross-sectional shape of pin locking end 82*c*, the shape being a double-D with opposing arcuate pin side surfaces 96*a* and 96*b* and connecting pin side surfaces 98*a* and 98*b* joining opposing arcuate pin side surfaces 96*a* and 96*b*. Preferably, opposing arcuate pin side surfaces 96*a* and 96*b* each coincide with the diameter of pin intermediate section 84 (FIGS. 4 and 5). However, opposing arcuate pin side surfaces 96*a* and 96*b* may each have a radius less than the radius of pin intermediate section 84. Opposing arcuate pin side surfaces 96*a* and 96*b* may also each have a radius less than the radius of intermediate seat 76. Optionally, the longitudinal edges formed at the junctures between adjacent surfaces 96*a*, 96*b*, 98*a*, and 98*b* may be eased with radii.

In the first preferred camshaft phaser embodiment, the cross-sectional shape of intermediate seat 76 taken perpendicular to central axis 87 is substantially dissimilar to the cross-sectional shape of pin locking end 82 taken perpendicular to longitudinal axis 86, and preferably, the cross-sectional shape of intermediate seat 76 is circular. Being substantially dissimilar encompasses having cross-sectional shapes that are described by different geometric shapes rather than having cross-sectional shapes that are described by the same geometric shapes which are only dimensioned differently.

The first preferred camshaft phaser embodiment may also include a radially orienting means for radially orienting intermediate locking pin 68 with intermediate seat 76. Referring now to FIGS. 4, 5, 6, and 7, three examples of preferable radially orienting means are shown.

FIGS. 4 and 5 show a first preferable radially orienting means that includes anti-rotation pin bore 100 located in intermediate locking pin bushing 70 for receiving anti-rotation pin 102 which may be a dowel pin, spring pin, split pin, or any other suitable pin. Anti-rotation pin bore 100 extends more or less perpendicular to, but offset from longitudinal axis 86 with a radial portion of anti-rotation pin bore 100 opening up into intermediate locking pin bushing bore 69. Anti-rotation pin 102 can be received by anti-rotation pin bore 100 in a slip fit relationship and is retained from subsequent migration out of anti-rotation pin bore 100 because the ends of anti-rotation pin bore 100 are closed by intermediate locking pin bore 72 (FIG. 1) after intermediate locking pin bushing 70 is pressed into intermediate locking pin bore 72. However, anti-rotation pin 102 could also be received by anti-rotation pin bore 100 in an interference fit relationship to prevent anti-rotation pin 102 from migrating out of anti-rotation pin bore 100 before intermediate locking pin bushing 70 is pressed into intermediate locking pin bore 72. Optionally, anti-rotation pin bore 100 may include counter-bore 101 (FIG. 4) to ease assembly of anti-rotation pin 102 into anti-rotation pin bore 100.

After anti-rotation pin 102 is installed in anti-rotation pin bore 100 and intermediate locking pin 68 is installed in intermediate locking pin bushing bore 69, circumferentially-exposed portion 103 of the anti-rotation pin 102 projects into intermediate locking pin bushing bore 69 and interacts with anti-rotation face 104 provided on intermediate locking pin 68 to prevent radial rotation of intermediate locking pin 68 in intermediate locking pin bushing bore 69. Anti-rotation face 104 of intermediate locking pin 68 can be a flatted portion of pin intermediate section 84, or, with reference to FIGS. 8*a*-8*c*, can include one of opposing parallel pin side surfaces 90*a*, 90*b*, one of connecting pin side surfaces 92*a*, 92*b*, 92*c*, 92*d*, 98*a*, 98*b*, or one of quadrilateral pin side surfaces 94*a*, 94*b*, 94*c*, 94*d* as well as an extension of the one of these surfaces into pin intermediate section 84. Since intermediate locking pin 68 is prevented from rotating within intermediate locking pin bushing bore 69 and intermediate locking pin bushing 70 is press fitted into intermediate locking pin bore 72, intermediate locking pin 68 is also prevented from rotating within intermediate locking pin bore 72.

Figure 6:
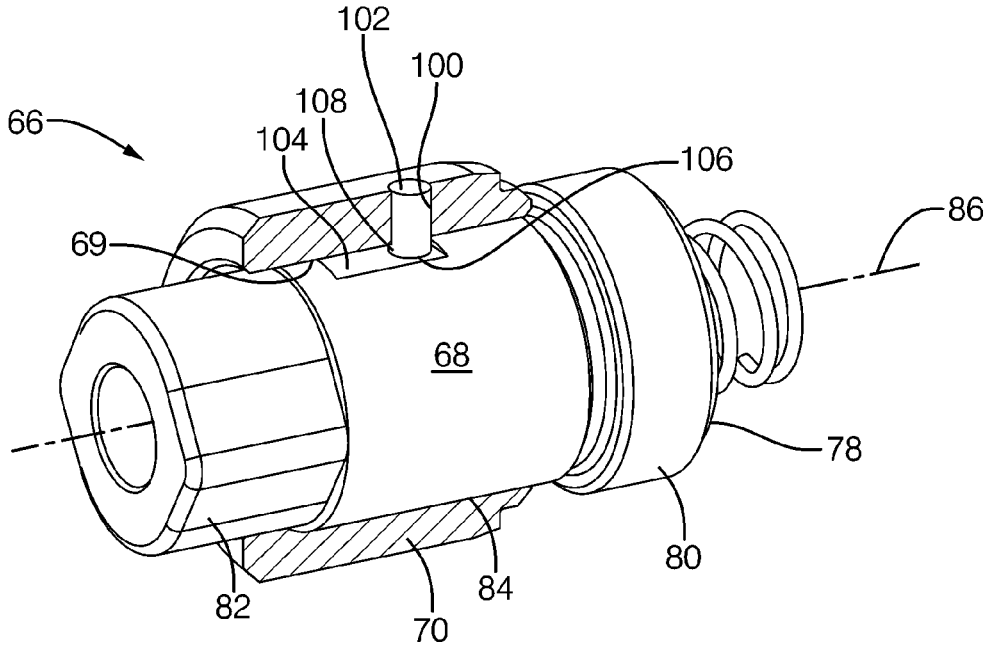
FIG. 6 is an isometric cross-sectional view of an intermediate locking pin assembly in accordance with the present invention.

FIG. 6 shows a second preferable radially orienting means that similarly includes anti-rotation pin bore 100 in intermediate locking pin bushing 70 for receiving anti-rotation pin 102 which may be a dowel pin, spring pin, split pin, or any other suitable pin. Anti-rotation pin bore 100 is again formed more or less perpendicular to longitudinal axis 86, however, in this example, anti-rotation pin bore 100 is more or less aligned with longitudinal axis 86 and opens up into intermediate locking pin bushing bore 69. Anti-rotation pin 102 can be received in anti-rotation pin bore 100 in a slip fit relationship and is retained from subsequent migration out of anti-rotation pin bore 100 by anti-rotation pin 102 being captured between intermediate locking pin 68 and intermediate locking pin bore 72 (FIG. 1*a*) after intermediate locking pin bushing 70 is pressed into intermediate locking pin bore 72. However, anti-rotation pin 102 could instead be received by anti-rotation pin bore 100 in an interference fit relationship to prevent anti-rotation pin 102 from migrating out of anti-rotation pin bore 100 before intermediate locking pin bushing 70 is pressed into intermediate locking pin bore 72.

After anti-rotation pin 102 is installed in anti-rotation pin bore 100 and intermediate locking pin 68 is installed in intermediate locking pin bushing bore 69, flat end surface 106 and diametral portion 108 of anti-rotation pin 102 project into intermediate locking pin bushing bore 69. Flat end surface 106 slideably interacts with anti-rotation face 104 provided on intermediate locking pin 68 to prevent radial rotation of intermediate locking pin 68 in intermediate locking pin bushing bore 69. Anti-rotation face 104 of intermediate locking pin 68 can be a flatted portion of pin intermediate section 84 of intermediate locking pin 68 or, with reference to FIGS. 8*a*-8*c*, can include one of opposing parallel pin side surfaces 90*a*, 90*b*, one of the connecting pin side surfaces 92*a*, 92*b*, 92*c*, 92*d*, 98*a*, 98*b*, or one of the quadrilateral pin side surfaces 94*a*, 94*b*, 94*c*, 94*d* as well as an extension of the one of these surfaces into pin intermediate section 84. Since intermediate locking pin 68 is prevented from rotating within intermediate locking pin bushing bore 69 and intermediate locking pin bushing 70 is press fitted into intermediate locking pin bore 72, intermediate locking pin 68 is also prevented from rotating within intermediate locking pin bore 72.

Figure 7:
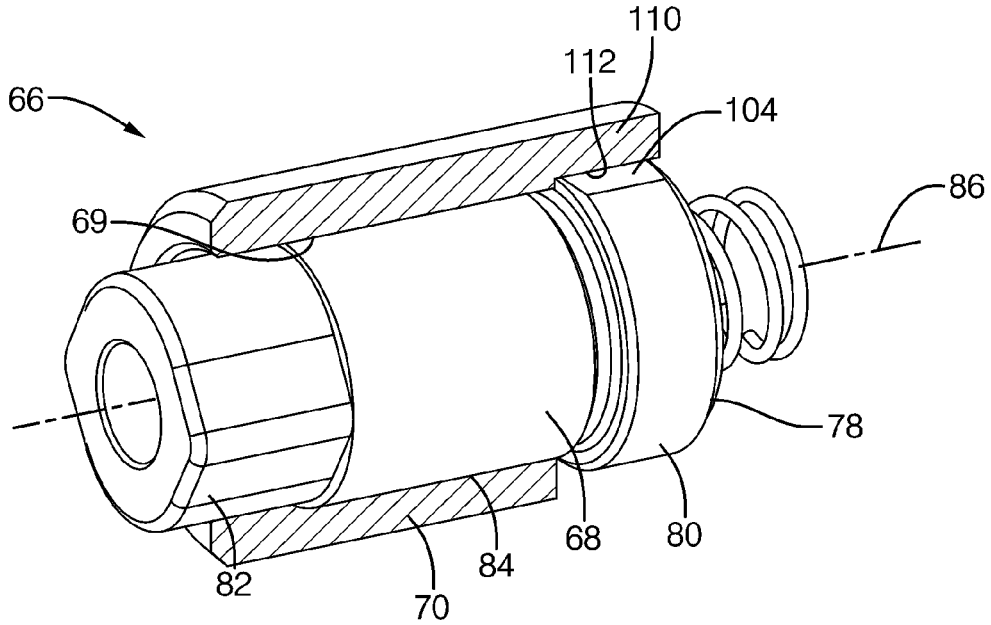
FIG. 7 is an isometric cross-sectional view of an intermediate locking pin assembly and corresponding seat in accordance with the present invention.

FIG. 7 shows a third preferable radially orienting means that includes anti-rotation extension 110 extending axially from intermediate locking pin bushing 70, anti-rotation extension 110 including flatted surface 112 that faces longitudinal axis 86. The radially orienting means also includes anti-rotation face 104 located on intermediate locking pin 68. However, in this example, anti-rotation face 104 is formed by flatting a radial portion of annular shoulder 80. After intermediate locking pin 68 is installed in intermediate locking pin bushing bore 69, flatted surface 112 of anti-rotation extension 110 interacts with anti-rotation face 104 of intermediate locking pin 68 to prevent radial rotation of intermediate locking pin 68 within intermediate locking pin bushing bore 69. Since intermediate locking pin 68 is prevented from rotating within intermediate locking pin bushing bore 69 and intermediate locking pin bushing 70 is press fitted into intermediate locking pin bore 72 (FIG. 1*a*), intermediate locking pin 68 is also prevented from rotating within intermediate locking pin bore 72.

Figure 9:
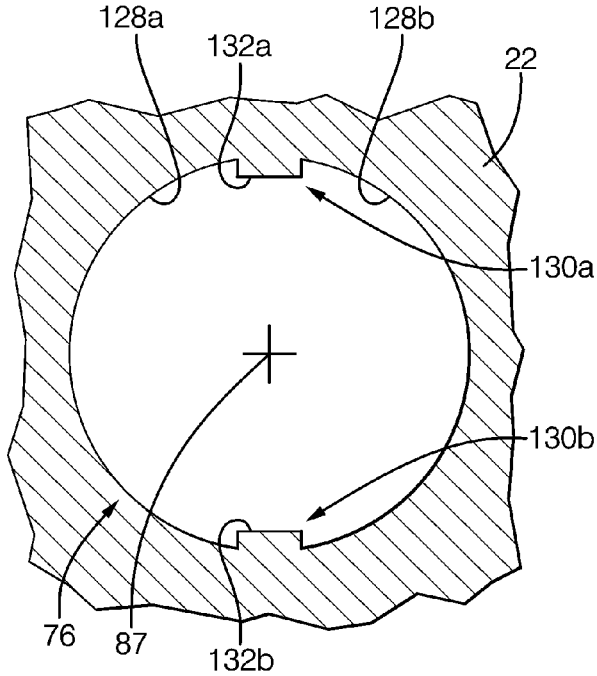
FIG. 9 is an orthographic cross-sectional view of an intermediate locking pin seat of a second embodiment of a camshaft phaser in accordance with the present invention.

With reference now to FIG. 9 in a second preferred camshaft phaser embodiment, the cross-sectional shape of intermediate seat 76 taken perpendicular to central axis 87 is non-circular in shape. In one example, intermediate seat 76 includes a pair of opposing arcuate seat surfaces 128*a* and 128*b* and a pair of opposing inwardly projecting lands 130*a* and 130*b* joining the pair of opposing arcuate seat surfaces 128*a* and 128*b*. Opposing inwardly projecting lands 130*a* and 130*b* include contact surfaces 132*a* and 132*b* contacted by pin locking end 82 (FIGS. 4, 5, 6, and 7) of intermediate locking pin 68 when pin locking end 82 is inserted into intermediate seat 76. Contact surfaces 132*a* and 132*b* may be flat or curved convexly or concavely. In this embodiment, the cross-sectional shape of pin locking end 82 taken perpendicular to longitudinal axis 86 is substantially dissimilar to the cross-sectional shape of intermediate seat 76 taken perpendicular to central axis 87, and preferably, the cross-sectional shape of pin locking end 82 is circular. Being substantially dissimilar encompasses having cross-sectional shapes that are described by different geometric shapes rather than having cross-sectional shapes that are described by the same geometric shapes which are only dimensioned differently.

Figure 2:
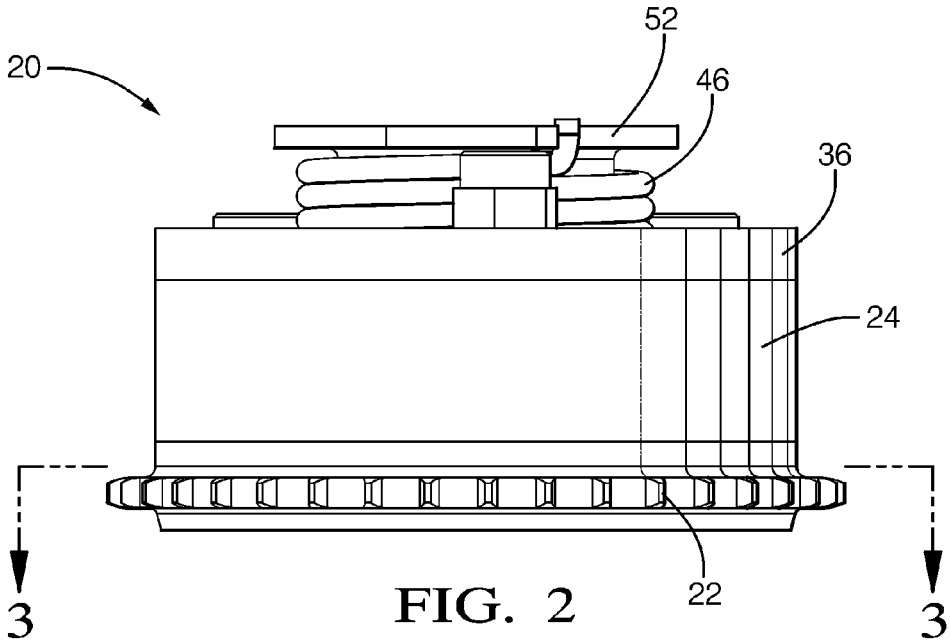
FIG. 2 is an orthographic view of a camshaft phaser in accordance with the present invention.
Figure 3:
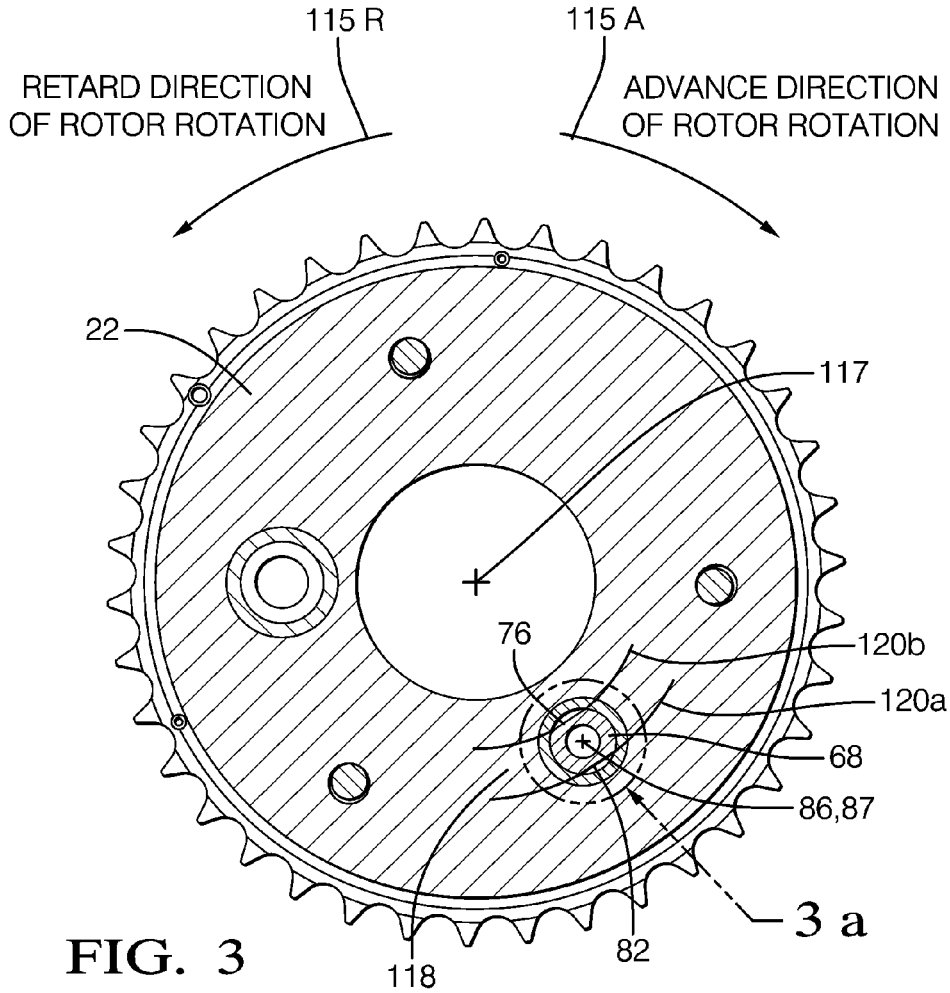
FIG. 3 is an orthographic view of a cross-section of the camshaft phaser of FIG. 2 along line 3-3.
Figure 3A:
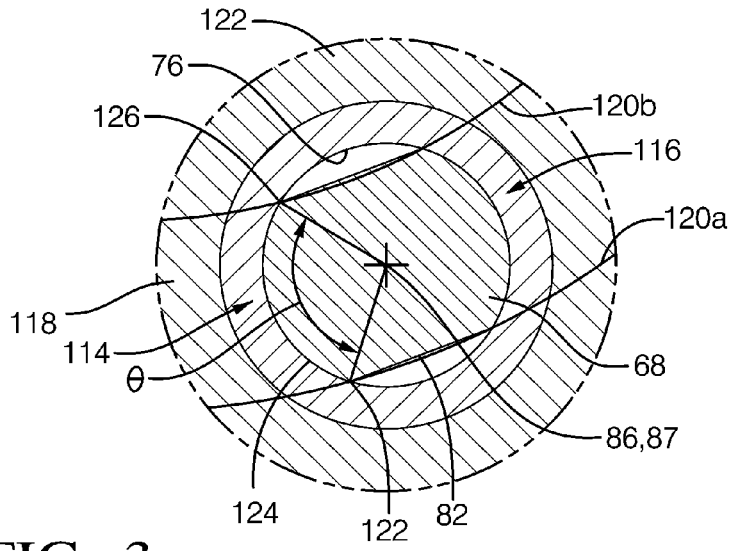
FIG. 3*a* is an enlarged view of the locking pin and seat shown in FIG. 3.

Referring now to FIGS. 2, 3, and 3*a*, FIG. 2 is an orthographic view of assembled camshaft phaser 20, FIG. 3 is cross-sectional view taken through sprocket/pulley 22, and FIG. 3*a* is an enlarged view of intermediate locking pin 68 and intermediate seat 76 from FIG. 3. When intermediate locking pin 68 is seated within intermediate seat 76, intermediate locking pin 68 and intermediate seat 76 are oriented with respect to each other such that pin locking end 82 and intermediate seat 76 form advance contact zone 114 when rotor 28 is urged in the advance direction indicated by arrow 115A, and retard contact zone 116 when rotor 28 is urged in the retard direction indicated by arrow 115R. Advance and retard contact zones 114, 116 are similarly formed regardless of the cross-sectional shape chosen for pin locking end 82, the cross-sectional shape chosen for intermediate seat 76, and the radially orienting means chosen to prevent radial rotation of intermediate locking pin 68 within intermediate locking pin bushing bore 69. Advance and retard contact zones 114, 116 are located within band 118 defined between two arcs 120*a* and 120*b* which have centers common to rotor center of rotation 117. One of arcs 120*a*, 120*b* passes through first end point 122 of segment 124 of the perimeter of pin locking end 82. The other of arcs 120*a*, 120*b* passes through second end point 126 of segment 124 of the perimeter of pin locking end 82. Segment 124 encompasses angle θ of the perimeter of pin locking end 82. Preferably, angle θ is less than or equal to 90 degrees and more preferably less than or equal to 20 degrees.

While the preferred camshaft phaser embodiments have been described with primary seat 64 and intermediate seat 76 being formed in pulley/sprocket 22, it is to be understood that seats 64, 76 could instead be formed in stator 24, or in any of the components that are rotationally fixed to stator 24, and therefore can generically be described as seats 64, 76 being formed in stator 24. It is also to be understood that the positions of primary and intermediate locking pin assemblies 54, 66 and their corresponding seats 64, 76 can be reversed from that described above. That is, primary and intermediate locking pin assemblies 54, 66 can be disposed in stator 24 (or any of the components that are rotationally fixed to stator 24) and corresponding seats 64, 76 can be disposed in rotor 28. It is further to be understood that seats 64, 76 need not be formed directly in rotor 28, stator 24, or any of the components that are rotationally fixed thereto, but rather may be formed in an insert that is subsequently affixed to one of the aforementioned components. It is even further to be understood that this invention is not limited to axial locking pins and seats, that is, locking pins that operate in axes parallel to that of the camshaft phaser axis, and can be readily applied to radial locking pins and seats that are known in the camshaft phaser art.

While the preferred camshaft phaser embodiments have been described as having one of pin locking end 82 and intermediate seat 76 having a non-circular cross-sectional shape and the cross-sectional shape of pin locking end 82 being substantially different from that of intermediate seat 76, it is to be understood that this aspect of the invention is similarly applicable to and encompasses primary locking pin 56 and primary seat 64. Therefore, this arrangement can be generically described as being one of a pin locking end of a locking pin and a seat having a non-circular cross-sectional shape, and the cross-sectional shape of the locking end of the locking pin having a cross-sectional shape substantially different from that of the seat.

While the preferred camshaft phaser embodiments of the cross-sectional shapes of pin locking end 82 of intermediate locking pin 68 has been described by example as a modified octagon, quadrilateral, and double-D shapes, it is to be understood that any polygon-shape may be chosen. This includes both regular and irregular polygons as well as convex and concave polygons. The vertices formed at the junctures between adjacent sides of the selected polygon-shape may be eased with radii, and the radii that fall within advance and retard contacts zones 114 and 116 have a radius that is less than or equal to the radius of pin intermediate section 84 of intermediate locking pin 68. The radii that fall within advance and retard contact zones 114 and 116 may also be less than or equal to the radius of intermediate seat 76. In addition to polygonal cross-sectional shapes, it is to be understood that oval or elliptical cross-sectional shapes could be chosen.

While this invention has been described in terms of the preferred embodiments thereof, it is not intended that it be so limited.

What is claimed is:

1. A camshaft phaser for advancing and retarding the timing of valves in an internal combustion engine, said camshaft phaser comprising:

a stator having a plurality of lobes;

a rotor selectively rotatably disposed within said stator and having a plurality of vanes interspersed with said stator lobes;

a locking pin slidably disposed in a first bore of one of said stator and said rotor, said locking pin having a pin locking end, a shoulder end, a pin intermediate section connecting said pin locking end and said shoulder end, and a longitudinal axis; and a seat for selectively receiving said pin locking end of said locking pin to secure said rotor against rotation within said stator, wherein one of said pin locking end of said locking pin and said seat has a non-circular cross section, wherein said pin locking end of said locking pin has a cross section substantially dissimilar to a cross section of said seat, and wherein said pin locking end of said locking pin and said seat form an advance contact zone in the advance direction of rotor rotation and a retard contact zone in the retard direction of rotor rotation.

2. The camshaft phaser of claim 1 wherein said advance and retard contact zones fall within a band defined by two arcs with centers common to a center of rotation of said rotor, one arc passing through a first end point of a 20 degree segment of the perimeter of said locking pin and the other arc passing through a second end point of said 20 degree segment of the perimeter of said locking pin.

3. The camshaft phaser of claim 2 wherein said pin locking end of said locking pin has a non-circular cross section.

4. The camshaft phaser of claim 3 wherein said non-circular cross section of said pin locking end of said locking pin is a modified octagon shape, wherein said modified octagon shape comprises at least one pair of opposing arcuate edges.

5. The camshaft phaser of claim 3 wherein at least one vertex of said modified octagon shape is eased by a radius.

6. The camshaft phaser of claim 3 wherein said non-circular cross section of said pin locking end of said locking pin is rhombus shaped.

7. The camshaft phaser of claim 3 wherein at least one vertex of said rhombus shape is eased by a radius.

8. The camshaft phaser of claim 3 wherein said non-circular cross section is a double-D shape.

9. The camshaft phaser of claim 2 wherein said seat has a non-circular cross section.

10. The camshaft phaser of claim 9 wherein said non-circular cross section of said seat comprises:

a pair of opposing arcuate edges; and a pair of opposing inward projecting lands joining said pair of opposing arcuate edges.

11. The camshaft phaser of claim 1 further comprising means for radially orienting said locking pin with said seat.

12. The camshaft phaser of claim 11 further comprising a locking pin bushing fixedly received in said first bore, said locking pin bushing comprising a locking pin bore for slidably receiving said locking pin.

13. The camshaft phaser of claim 12 wherein said radially orienting means comprises:

an anti-rotation face located on said locking pin; and an anti-rotation pin projecting into said locking pin bore of said locking pin bushing, wherein said anti-rotation pin interacts with said anti-rotation face to prevent radial rotation of said locking pin in said first bore.

14. The camshaft phaser of claim 13 wherein said anti-rotation face is located on said pin intermediate section of said locking pin.

15. The camshaft phaser of claim 13 wherein only a portion of the outside radial surface of said anti-rotation pin projects into to said second bore of said locking pin bushing.

16. The camshaft phaser of claim 15 wherein said outside radial surface of said anti-rotation pin interacts with said anti-rotation face of said locking pin to prevent radial rotation of said locking pin in said first bore.

17. The camshaft phaser of claim 13 wherein one end surface of said anti-rotation pin and a portion of said outside radial surface of said anti-rotation pin projects into to said locking pin bore of said locking pin bushing.

18. The camshaft phaser of claim 17 wherein said one end surface of said anti-rotation pin interacts with said anti-rotation of said locking pin to prevent radial rotation of said locking pin in said first bore.

19. The camshaft phaser of claim 13 wherein said anti-rotation pin is selected from the group consisting of a dowel pin, spring pin, split pin, and roll pin.

20. The camshaft phaser of claim 12 wherein said radially orienting means comprises:

an anti-rotation face located on said shoulder end of said locking pin; and an anti-rotation extension extending axially from locking pin bushing, wherein said anti-rotation extension interacts with said anti-rotation face to prevent radial rotation of said locking pin in said first bore.

* * * * *